United States Patent [19]

Oda

[11] Patent Number: 4,521,942

[45] Date of Patent: Jun. 11, 1985

[54] LOCKABLE SLIDE FASTENER SLIDER

[75] Inventor: Kiyoshi Oda, Namerikawa, Japan

[73] Assignee: Yoshida Kogyo K. K., Tokyo, Japan

[21] Appl. No.: 472,007

[22] Filed: Mar. 4, 1983

[30] Foreign Application Priority Data

Mar. 6, 1982 [JP] Japan ..... 57-31883[U]

[51] Int. Cl.[3] ..... A44B 19/30

[52] U.S. Cl. ..... 24/419; 24/387; 24/420; 24/427

[58] Field of Search ..... 24/417, 419, 387, 420, 24/427, 428

[56] References Cited

U.S. PATENT DOCUMENTS

| | | | |
|---|---|---|---|
| 1,919,662 | 7/1933 | Legat | 24/420 |
| 2,269,879 | 1/1942 | Marinsky | 24/419 |
| 2,923,993 | 2/1960 | Breithaupt | 24/419 |
| 3,230,593 | 1/1966 | Hertz | 24/427 |
| 3,820,203 | 6/1974 | Takamatsu | 24/419 |
| 3,899,804 | 8/1975 | Kawashima | 24/419 |

FOREIGN PATENT DOCUMENTS

| | | | |
|---|---|---|---|
| 636213 | 2/1962 | Canada | 24/419 |
| 532431 | 1/1941 | United Kingdom | 24/420 |
| 631042 | 7/1947 | United Kingdom | 24/420 |
| 661719 | 11/1951 | United Kingdom | 24/419 |

*Primary Examiner*—Victor N. Sakran

*Attorney, Agent, or Firm*—Hill, Van Santen, Steadman & Simpson

[57] ABSTRACT

A lockable slide fastener slider having a guide groove which allows a pair of rows of coupling elements to pass smoothly through a guide channel without entering an aperture communicating with the guide channel, even when the coupling elements are displaced toward the aperture. The guide groove is defined jointly by a bottom wall and a pair of oblique sidewalls diverging toward the guide channel, the bottom wall having a width substantially the same as that of the aperture. The peripheral wall bounding the aperture has an oblique end portion facing the guide channel and merging into the oblique sidewalls.

5 Claims, 6 Drawing Figures

LOCKABLE SLIDE FASTENER SLIDER

BACKGROUND OF THE INVENTION

1. Field of the Invention:

The present invention relates to slide fasteners, and more particularly to a slide fastener slider which can be locked against movement in a desired position on a pair of rows of coupling elements.

2. Prior Art:

Conventional lockable sliders comprise a slider body having in its upper wing an aperture through which a locking element is movable into and out of locking engagement with at least one coupling element within the slider body. In such known lockable slider, at least one row of coupling elements is likely to tilt within the slider body and successively enter the aperture and impinge upon a peripheral edge of the aperture when the slider slides along the pair of rows of coupling elements. Consequently, the movement of the slider becomes sluggish. Furthermore, sewing stitches, which secure the rows of coupling elements to respective slide fastener stringer tapes, are likely to be damaged or sometimes broken during repeated engagement with the edge of the aperture.

SUMMARY OF THE INVENTION

A lockable slide fastener slider comprises a slider body having a substantially Y-shaped guide channel defined between a pair of first and second wings joined at one end. The first wing has an aperture communicating with the guide channel and bounded by a peripheral wall. The first wing further has in its inside surface an elongate guide groove extending longitudinally from the aperture to the opposite end of the first wing. The groove is defined jointly by a bottom wall and a pair of oblique sidewalls diverging toward the guide channel, the bottom wall having a width substantially the same as that of the aperture. The peripheral wall has an oblique end portion facing the guide channel and merging into the oblique sidewalls. During slide fastener-opening and fastener-closing operation, a pair of rows of coupling elements is continuously guided by the continuous oblique sidewalls and end portion and passes smoothly in and along the guide groove without entering the aperture. The aperture is located laterally off the longitudinal center line of the guide channel to such an extent that a line of sewing stitches, which secures the row of coupling elements, passes guidedly on one of the oblique sidewalls.

It is therefore an object of the present invention to provide a lockable slide fastener slider having a guide groove which allows a pair of rows of coupling elements to pass smoothly through a guide channel without entering an aperture communicating with the guide channel.

Another object of the present invention is to provide a lockable slide fastener slider having a guide groove which protects a line of sewing stitches against damage or breakage.

Many other advantages, features and additional objects of the present invention will become manifest to those versed in the art upon making reference to the detailed description and the accompanying drawings in which a preferred embodiment incorporating the principles of the present invention is shown by way of illustrative example.

DETAILED DESCRIPTION

Figure 1:
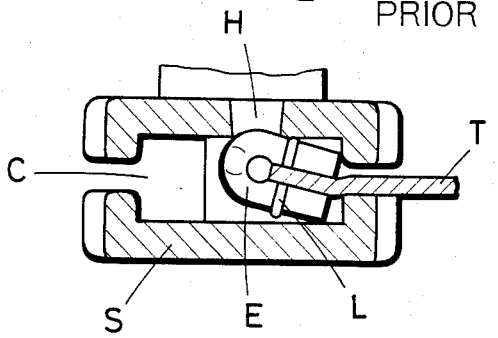
FIG. 1 PRIOR ART
FIG. 1 is a schematic fragmentary cross-sectional view explaining a problem associated with a conventional lockable slide fastener slider.
Figure 2:
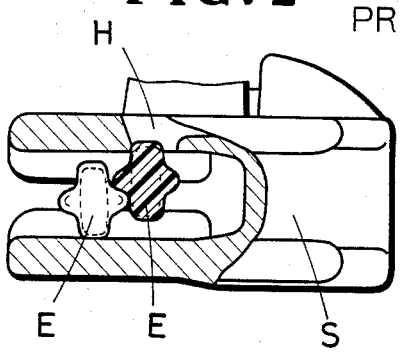
FIG. 2 PRIOR ART
FIG. 2 is a schematic fragmentary side elevational view, partly in cross section, of the conventional slider.

As shown in FIGS. 1 and 2, a conventional lockable slide fastener slider comprises a slider body S having a guide channel C for the passage therethrough of a pair of rows of coupling elements E,E. The slider body S further has in its upper wing an aperture or hole H through which a locking element (not shown) moves into and out of locking engagement with the coupling elements E,E in the slider body S.

When being coupled together the rows of coupling elements E,E are likely to tilt upwardly in a direction perpendicular to the general plane of corresponding stringer tapes T (only one shown in FIG. 1), due primarily to forces applied to the interengaged coupling elements and deformation of them caused by such forces. The rows of coupling elements E,E thus tilted successively partially enter the hole H and impinge upon a peripheral edge of the hole H as the slider slides on and along them, thereby hindering smooth sliding movement of the slider. Such phenomenon occurs frequently in slide fasteners having rows of molded continuous coupling elements secured by sewing stitches to respective stringer tapes. Furthermore, a line of sewing stitches L, which secures one row of coupling elements E to the corresponding tape T, is likely to become damaged or sometimes broken during repeated engagement with the peripheral edge of the hole H.

The present invention is described hereinbelow with reference to FIGS. 3 through 6.

Figure 3:
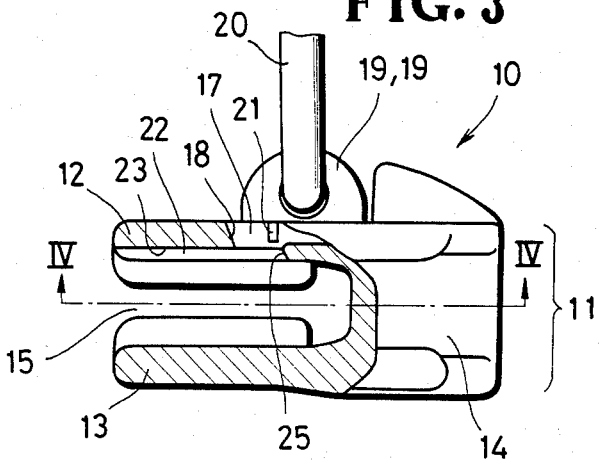
FIG. 3 is a fragmentary side elevational view, partly in cross section, of a lockable slide fastener slider according to the present invention.
Figure 4:
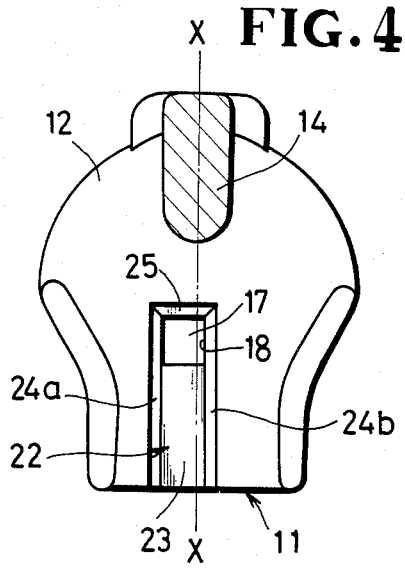
FIG. 4 is a cross-sectional view taken in a horizontal plane by line IV—IV of FIG. 3
Figure 5:
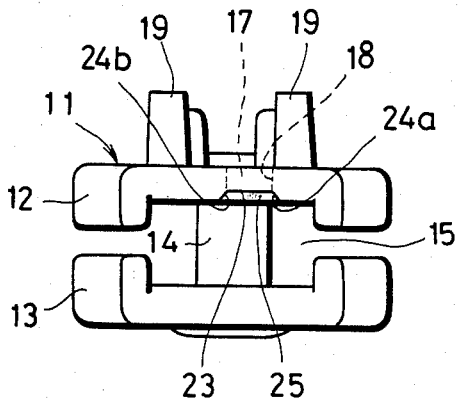
FIG. 5 is a schematic end elevational view of the slider of FIG. 3.
Figure 6:
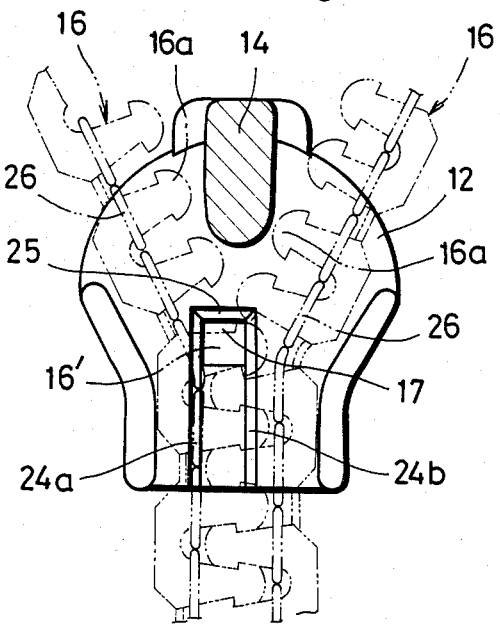
FIG. 6 is a view similar, to FIG. 4 showing a positional relation between the slider and its related parts.

In FIGS. 3 to 5, a lockable slide fastener slider 10 comprises a slider body 11 including a pair of flanged first and second (upper and lower) wings 12,13 joined at one end by a neck 14 so as to define a substantially Y-shaped guide channel 15 between the wings 12,13 for the passage therethrough of a pair of coupling element rows 16,16 (shown by phantom lines in FIG. 6) of a slide fastener (not shown). The upper wing 12 has a rectangular aperture 17 communicating with the guide channel 15 and bounded by a peripheral wall 18. The upper wing 12 further has a pair of laterally spaced lugs 19,19 one on each side of the aperture 17. As shown in FIG. 6, the coupling element rows 16,16 are secured to respective stringer tapes (not shown) by a pair of lines of sewing stitches 26,26, respectively. Each coupling element row 16 comprises a series of interconnected coupling elements produced by extrusion molding, each coupling element having a generally mushroom-shaped coupling head 16'.

As shown in FIG. 3, a pull tab 20 is pivotably connected at one end to the lugs 19,19 and hence is pivotably movable on the upper wing 12. A locking element in the form of a pin 21 is operatively connected to the pull tab 20 and is movable, in response to the pivotal movement of the pull tab 20, through the aperture 17 into and out of locking engagement with at least one coupling element 16' of one of the coupling element rows 16 (FIG. 6) within the slider body 11.

As shown in FIGS. 4 and 5, the upper wing 12 has in its inside surface an elongated shallow guide groove 22 extending longitudinally from the aperture 17 to the opposite end of the upper wing 12. The groove 22 is defined jointly by a bottom wall 23 and a pair of oblique sidewalls **24*a*,24*b* extending divergently from the bottom wall 23 toward the guide channel 15. The bottom wall 23 has a width substantially the same as the width of the aperture 17, and the sidewalls 24*a*,24*b* diverge at an obtuse angle. The peripheral wall 18 bounding the aperture 17 has an oblique end portion 25 facing to the guide channel 15 and merging into the sidewalls 24*a*,24*b***.

As shown in FIGS. 4 and 6, the aperture 17 and the groove 22 are located laterally off or out of alignment with the longitudinal center line X—X (FIG. 4) of the guide channel 15 to such an extent that one line of sewing stitches 26 (FIG. 6) extends in vertical alignment with one of the sidewalls **24*a*. The width and the depth of the guide groove 22 are determined of the aperture 17, and the coupling head 16' and also the extent of overlap of the coupling head 16' in the aperture 17 caused by the degree of engagement of the rows of coupling elements 16, 16 and depending on the dimensions of the Y-shaped guide channel 15**.

With this arrangement, even when the rows of coupling elements 16,16 are tilted or displaced in the guide channel 15 upwardly toward the upper wing 12, such displaced coupling elements enter the guide groove 22 and then they are guided by the oblique end portion 25 and the oblique sidewalls **24*a*,24*b* to move smoothly along the guide groove 22, 15 without entering the aperture 17. Thus, the slider 10 can slide smoothly on and along the rows of coupling elements 16. Furthermore, the sewing stitches 26 pass guidedly on and along one of the oblique sidewalls 24*a* without interference with the peripheral edge of the aperture 17** so that they are protected from damage or breakage during the use of the slide fastener.

The principles of the invention are further useful when embodied in lockable slide fastener sliders manufactured by die-casting or molding. With the provision of the oblique end portion 25, the slider can be removed from a mold easier than those sliders having a sharp edge bounding an aperture.

Although various minor modifications may be suggested by those versed in the art, it should be understood that I wish to embody within the scope of the patent warranted hereon, all such embodiments are reasonably and properly come within the scope of my contribution to the art.

What I claim as my invention:

1. A lockable slider for a slide fastener having a pair of rows of coupling elements, said slider comprising:

(a) a slider body including a pair of first and second wings joined at one end by a neck to define therebetween a substantially Y-shaped guide channel for the passage therethrough of the pair of coupling element rows, said first wing having an aperture communicating with said guide channel and bounded by a peripheral wall, said first wing having in its inside surface an elongated groove extending from said aperture to the opposite end of said first wing, said groove being defined jointly by a bottom wall and a pair of oblique sidewalls diverging toward said guide channel, said bottom wall having a width substantially the same as that of said aperture, said peripheral wall having an oblique end portion facing said guide channel and merging into said oblique sidewalls;

(b) a pull tab pivotably connected to said first wing; and (c) a locking element operatively connected to said pull tab and movable through said aperture into and out of locking engagement with at least one coupling element of the pair of coupling element rows in said guide channel.

2. A lockable slider according to claim 1, said sidewalls diverging at an obtuse angle.

3. A lockable slider for a slide fastener having a pair of rows of coupling elements sewn by a pair of lines of sewing stitches respectively to a pair of stringer tapes, said slider comprising:

(a) a slider body including a pair of first and second wings joined at one end by a neck to define therebetween a substantially Y-shaped guide channel for the passage therethrough of the pair of coupling element rows, said first wing having an aperture communicating with said guide channel and bounded by a peripheral wall, said first wing having in its inside surface an elongated groove extending from said aperture to the opposite end of said first wing, said groove being defined jointly by a bottom wall and a pair of oblique sidewalls diverging toward said guide channel, said bottom wall having a width substantially the same as that of said aperture, said peripheral wall having an oblique end portion facing said guide channel and merging into said oblique sidewalls, one of said sidewalls extending in vertical alignment with one of the lines of sewing stitches;

(b) a pull tab pivotably connected to said first wing; and (c) a locking element operatively connected to said pull tab and movable through said aperture into and out of locking engagement with at least one coupling element of the pair of coupling element rows in said guide channel.

4. A lockable slider according to claim 3, said sidewalls diverging at an obtuse angle.

5. A lockable slider according to claim 3, said aperture being displaced off the longitudinal center-line of said guide channel.

* * * * *